United States Patent [19]

Crawford

[11] 3,995,674

[45] Dec. 7, 1976

[54] TELEVISION TOP PROTECTOR

[76] Inventor: Virginia E. Crawford, 1301 N. Main St., Miami, Okla. 74354

[22] Filed: Nov. 11, 1974

[21] Appl. No.: 522,338

[52] U.S. Cl. ..... 150/52

[51] Int. Cl.[2] ..... A47C 31/10

[58] Field of Search ..... 150/52; 276/44; 312/7, 312/8

[56] References Cited

UNITED STATES PATENTS 3,782,435 1/1974 Sherman ..... 150/52 R

FOREIGN PATENTS OR APPLICATIONS 609,425 11/1960 Canada ..... 150/52 R 1,288,975 6/1969 Germany ..... 150/52 R 328,493 8/1935 Italy ..... 150/52 R

*Primary Examiner*—Ro E. Hart

*Attorney, Agent, or Firm*—Edwin H. Crabtree

[57] ABSTRACT

A television top protector secured to and substantially covering a horizontal top of a television cabinet. The protector is constructed so that food, drink, cigarettes, and sundries placed on the protector will slide off of the front or sides of the protector, thereby protecting the top surface of the cabinet and preventing damage to electrical circuitry located at the rear of the cabinet.

7 Claims, 4 Drawing Figures

TELEVISION TOP PROTECTOR

BACKGROUND OF THE INVENTION

This invention relates generally to television accessories and more particularly, but not by way of limitation, to a television top protector for protecting the top of a television cabinet.

Heretofore, television sets subject to public use such as hotel and motel rooms, etc. furnished with expensive television sets have the problem of guests setting food and drink on the top of the television cabinet. Often the food and drink are spilled backwards into air vents of the electrical circuitry at the rear of the cabinet causing excessive damage to the television set. Also, items setting on top of the cabinet often spill and stain or burn the cabinet causing expense replacement of the cabinet and lost use of the television set.

There are various prior art television sets having sloping cabinet tops at an angle to the horizontal. There are also television cabinets with hinged tops which can be lifted and secured at an angle to the horizontal. These angled tops are an integral part of the television cabinet and are not constructed to protect the top of the cabinet or to be removed from the cabinet. None of these prior art sets disclose an inexpensive television top protector easily removed and designed to be secured to the top of the television cabinet. Also, none of the prior art sets disclose a separate television top protector to prevent the spilling of food and drinks on the cabinet top or into the electrical circuitry air vents located at the rear of the cabinet.

Book supports and lecterns have a similar structure to the subject invention, but they are placed on a table or stand to support books, papers, notes, etc. The supports and lecterns are not designed to be secured to the top of a television cabinet.

There is a prior art toilet tank cover and cabinet for storing toilet articles on the top of a toilet tank. This cabinet has a sloping hinged front to prevent the resting of articles on the top of the cabinet. This invention discloses the need of storing articles inside the toilet tank cover and cabinet to prevent toilet articles from falling into the toilet. There is no teaching the need to protect the top of the toilet tank.

SUMMARY OF THE INVENTION

The subject invention solves the problem of protecting the top of a television cabinet and the preventing of spilling, staining and burning the top of the cabinet. The invention also prevents various items from falling into the air vents of the electrical circuitry at the rear of the cabinet.

The invention is a detachable television top protector for securing to the top of the television cabinet. The protector, by varying the angle of its side portions and front portion from 20° to 90° from the horizontal, prevents the resting of the articles thereon. By having the side portions and the front portion of the protector sloping down and away from the vertical back portion of the protector, the articles are prevented from falling into the electrical circuitry air ducts at the rear of the television cabinet.

The television top protector includes a vertical back portion disposed against the horizontal top of a television cabinet and extending substantially the length of the rear of the television cabinet. A front portion of the protector is disposed against the top of the television cabinet and extends along the length of the front of the television cabinet. The front portion extends upwardly at an angle from 20° to 90° from the horizontal. The protector has two side portions disposed against the top of the television cabinet and extends along the width of the sides of the television cabinet. The side portions extend upwardly at an angle from 20° to 90° from the horizontal and intersects the back and front portions, thereby enclosing the protector.

The advantages and objects of the invention will become evident from the following detailed description when read in conjunction with the accompany drawings which illustrate the preferred embodiments of the invention.

DETAILED DESCRIPTION

Figure 1:
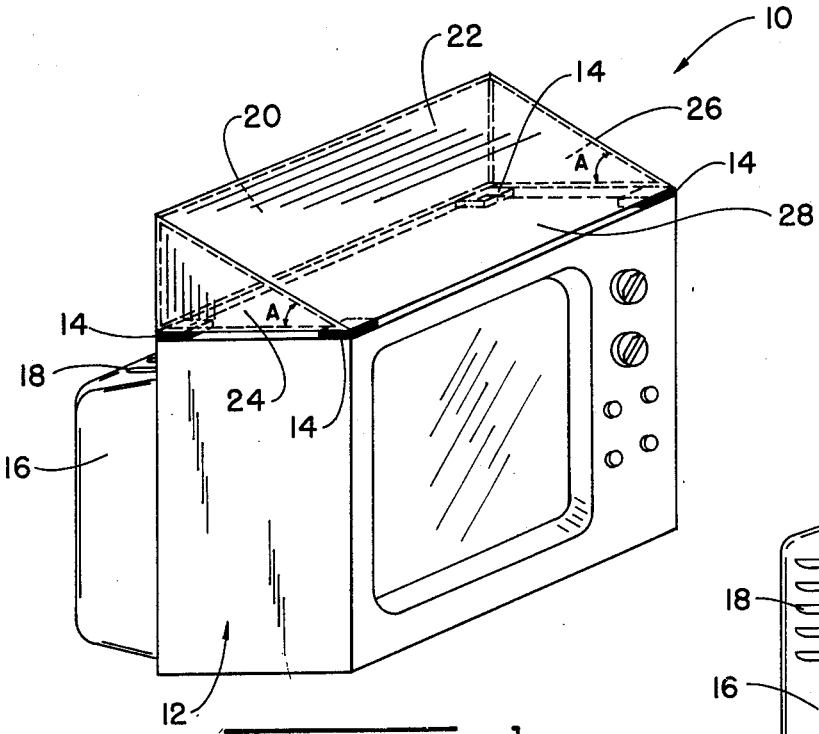
FIG. 1 is a perspective view of the television top protector substantially covering the top of the television cabinet.

In FIG. 1 the television top protector is designated by the general reference character 10. The protector 10 is secured to the top of a television cabinet 12 by adhesive pads 14. While pads 14 are used in this illustration, it is recognized that suction cups, clamps, magnets or any other means for securing the protector 10 to the top of the cabinet may be used. The television cabinet 12 includes a rear extension 16 for housing the television's electrical circuitry. The extension 16 includes air vents 18 for dissipating the heat generated during the use of the television.

The protector 10 in FIG. 1 has a wedge shaped structure having a vertical back portion 20, a front portion 22 at an angle A which is greater than 20° and less than 90° from the horizontal, two vertical side portions 24 and 26, and a bottom portion 28. The most practical design shows angle A to be at 22½°. The bottom portion 28 may have various dimensions depending on the dimensions of the cabinet top. The bottom portion 28 is constructed to substantially cover the top of the television cabinet to eliminate any chance of the resting of articles on the cabinet top. The back portion 20 is vertical so that the intersecting front portion 22 slopes downward toward the front of the television cabinet to eliminate food or drink from falling backwards and spilling into the air vents 18.

The protector 10 is shown as a self-enclosed structure. It is recognized that the protector 10 can be constructed without a bottom portion 28. Also, the protector could be constructed without the side portions 24 and 26 or without the back portion 20. But, it is desirable that the protector 10 be enclosed to prevent the storing of articles therein, which may damage the cabinet top.

Figure 2:
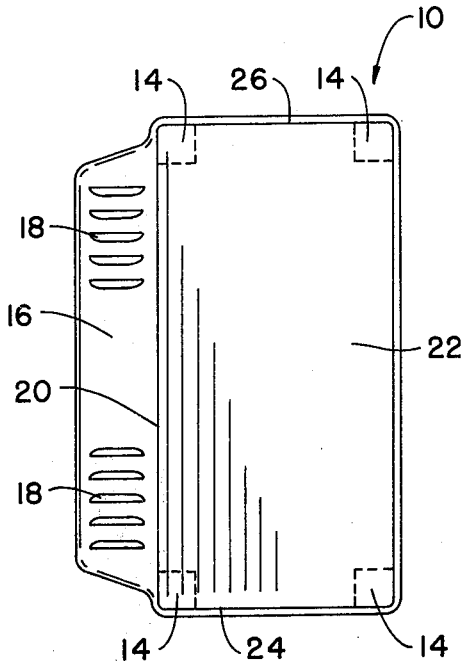
FIG. 2 is a top view of the television top protector illustrated in FIG. 1.

FIG. 2 is a top view of the protector 10 shown in FIG. 1. This view more clearly illustrates the rear extension 16 and air vents 18 in the extension.

Figure 3:
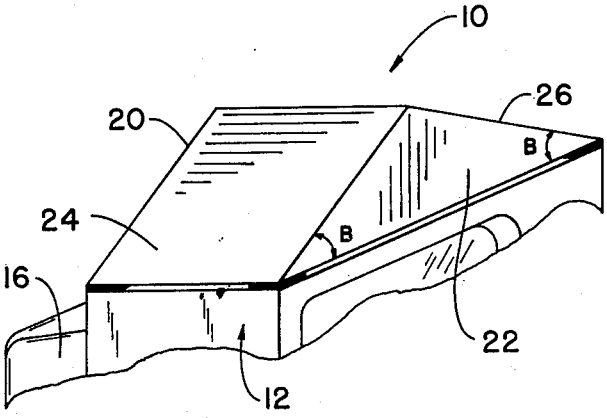
FIGS. 3 and 4 are alternate embodiments of the television top protector.

FIG. 3 is an alternate embodiment of the protector 10. The protector 10 in this illustration has a triangular structure. The protector 12 includes the vertical back portion 20, the front portion 22 in a vertical position, and side portions 24 and 26 at an angle B which is greater than 20° but less than 90° from the horizontal.

Figure 4:
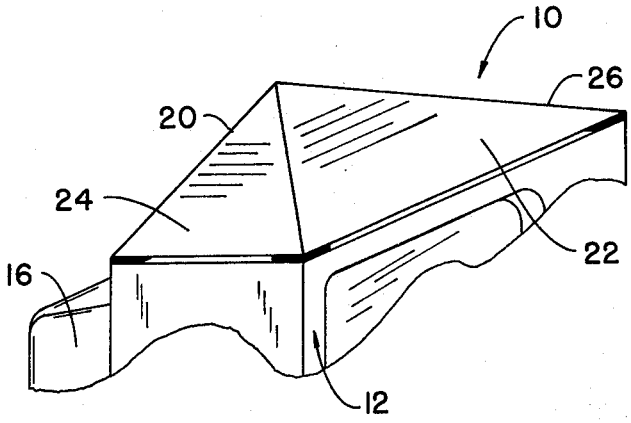

FIG. 4 is another alternate embodiment of the protector 10 having a pyramidal shaped structure. Here again, the back portion 10 is vertical but in this illustration both the front portion 22 and the side portions 24 and 26 are sloped at an angle less than 90° but greater than 20° from the horizontal.

The protector 10 can be constructed from a variety of material such as wood, fiberglass, plastic, glass, etc. The protector can also have a variety of appearances such as a wood grain texture to match the texture of the television cabinet or a decorative design which is pleasing to the eye.

In the above illustrations, it has been mentioned that the angles of the front portion 22 and the side portions 24 and 26 may vary at an angle from the horizontal from 20° to 90°. It has been found that a surface on the protector at an angle less than 20° may retain various articles, thereby defeating the purpose of discouraging the placement of these articles on the protector.

Changes may be made in the construction and arrangement of the parts or elements of the embodiments as disclosed herein without departing from the spirit or scope of the invention as defined in the following claims.

What is claimed is:

1. A television top protector to prevent the placement of food, drink, cigarette and sundries on a horizontal top of a television cabinet, the protector comprising:

a vertical back portion disposed on top of the television cabinet and extending the length of the rear of the television cabinet;

a front portion disposed on top of the television cabinet and extending the length of the front of the television cabinet, said front portion extending upwardly at an angle from 20° to 90° from the horizontal; and side portions disposed on top of the television cabinet and extending the width of the sides of the television cabinet, said side portions extending upwardly at an angle from 20° to 90° from the horizontal, said side portions intersecting and integrally attached to said back and front portions, thereby enclosing the protector.

2. The protector as described in claim 1 and further including a horizontal bottom portion attached to said back portion, front portion and side portions, said bottom portion having substantially the same dimensions as the top of the television cabinet and disposed thereon.

3. The protector as described in claim 1 wherein said side portions are vertical and said front portion is at an angle greater than 20° and less than 90° forming a wedge shaped structure.

4. The protector as described in claim 1 wherein said front portion is vertical and said side portions are at an angle greater than 20° and less than 90° forming a triangular shaped structure.

5. The protector as described in claim 1 wherein said side portions and said front portion are at an angle greater than 20° and less than 90° forming a pyramidal shaped structure.

6. A television top protector to prevent the placement of food, drink, cigarette and sundries on the horizontal top of a television cabinet, the protector comprising:

a bottom portion disposed on the top of the television cabinet and having substantially the same dimensions as the top of the television cabinet;

a vertical back portion attached to said horizontal bottom portion and extending the length of the rear of the television cabinet;

a front portion attached to said bottom portion and extending the length of the front of the television cabinet, said front portion extending upwardly at an angle from 20° to 90° from the horizontal; and side portions attached to said bottom portion and extending the width of the sides of the television cabinet, said side portions extending upwardly at an angle from 20° to 90° from the horizontal, said side portions intersecting and integrally attached to said back and front portions, thereby enclosing the protector.

7. The protector as described in claim 1 wherein said bottom portion of the protector is secured to the top of the cabinet to prevent the removal thereof.

* * * * *